US010116079B1

(12) United States Patent
Ju et al.

(10) Patent No.: US 10,116,079 B1
(45) Date of Patent: Oct. 30, 2018

(54) ELECTRICAL CONNECTOR AND TERMINAL THEREOF

(71) Applicant: LOTES CO., LTD., Keelung (TW)

(72) Inventors: Ted Ju, Keelung (TW); Chien Chih Ho, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 15/818,878

(22) Filed: Nov. 21, 2017

(51) Int. Cl.
*H01R 13/24* (2006.01)
*H01R 12/52* (2011.01)

(52) U.S. Cl.
CPC ..... *H01R 13/2442* (2013.01); *H01R 12/523* (2013.01)

(58) Field of Classification Search
CPC ..... H01R 13/2442; H01R 12/253
USPC ..... 439/658
See application file for complete search history.

(56) References Cited

U.S. PATENT DOCUMENTS 2,097,324 A * 10/1937 Hill ..... H02B 13/005 174/119 C
4,884,976 A * 12/1989 Franks, Jr. ..... B23K 37/0435 439/433
4,966,563 A * 10/1990 Pierce ..... H01R 25/142 439/729
5,052,954 A * 10/1991 Seidler ..... H01R 12/57 29/843
5,090,116 A * 2/1992 Henschen ..... B23K 3/0475 29/827
6,206,735 B1 * 3/2001 Zanolli ..... H01R 12/585 439/404
6,708,932 B1 * 3/2004 Gazdik ..... H02G 3/32 248/71
6,905,377 B2 * 6/2005 Murr ..... H01R 12/57 439/330
6,976,888 B2 * 12/2005 Shirai ..... H01R 13/2442 439/733.1
7,297,010 B2 * 11/2007 Tsai ..... H01R 13/2442 439/331

(Continued)

FOREIGN PATENT DOCUMENTS

CN 1571627 A 1/2005
CN 101212095 A 7/2008

(Continued)

*Primary Examiner* — Alexander Gilman
(74) *Attorney, Agent, or Firm* — Locke Lord LLP; Tim Tingkang Xia, Esq.

(57) ABSTRACT

An electrical connector and a terminal thereof are disclosed. The terminal includes a base for being retained in an accommodating hole of an insulating body, a contact arm formed by bending and extending upward from the base for abutting a chip module, a conducting portion formed by extending from the base for being conductively connected with a circuit board, and a strip connecting portion for being connected with a strip. A plate surface of the strip connecting portion is attached to a plate surface of the contact arm. Since the plate surface of the strip connecting portion is attached to the plate surface of the contact arm, a width of the terminal is not increased, thereby facilitating intensive arrangement of the terminals, reducing a gap between the strip connecting portion and the plate surface of the contact arm, and preventing from the wooden pile effect of the strip connecting portion.

20 Claims, 8 Drawing Sheets

(56) References Cited

U.S. PATENT DOCUMENTS

| | | | | |
|---|---|---|---|---|
| 7,497,744 | B2 * | 3/2009 | Tsai | H01R 12/57 439/331 |
| 8,821,196 | B2 * | 9/2014 | Blasick | H01R 13/111 439/851 |
| 9,614,299 | B2 * | 4/2017 | Ludwig | H01R 4/28 |
| 9,843,120 | B2 * | 12/2017 | Matsushita | H01R 13/11 |
| 2005/0070175 | A1 * | 3/2005 | Hashimoto | H05K 7/1061 439/862 |
| 2007/0173137 | A1 * | 7/2007 | Liao | H01R 12/57 439/862 |

FOREIGN PATENT DOCUMENTS

| | | | |
|---|---|---|---|
| CN | 101227039 | A | 7/2008 |
| CN | 201156588 | Y | 11/2008 |
| CN | 201355656 | Y | 12/2009 |
| CN | 202797350 | U | 3/2013 |
| CN | 204088669 | U | 1/2015 |

* cited by examiner

100

A-A

ELECTRICAL CONNECTOR AND TERMINAL THEREOF

FIELD

The present invention relates to an electrical connector and a terminal thereof, in particular to an electrical connector used for electrically connecting a chip module to a circuit board and a terminal thereof.

BACKGROUND

Chinese patent CN201420377264.4 discloses an electrical connector with terminals capable of being arranged intensively. The terminals are formed through punching of a metal sheet, and each terminal includes: an assembly portion, an elastic arm formed by bending and extending upward from the assembly portion for abutting a chip module, and a strip connecting portion. The strip connecting portion is in the shape of a flat plate, a top end of the strip connecting portion is higher than the assembly portion and is connected with a strip. A plate surface of the strip connecting portion is soldered to a plate surface of the assembly portion, thereby avoiding the strip connecting portion and the assembly portion from being located in the same plane, reducing the width of the terminals, and facilitating an intensive arrangement of the terminals. However, the top end of the strip connecting portion is higher than the assembly portion, the plate surface of the strip connecting portion is attached to the plate surface of the assembly portion, and the elastic arm is formed by bending and extending from the assembly portion, so that a large gap exists between the plate face of the strip connecting portion and a plate face of the elastic arm. As a result, an antenna branch is formed by the strip connecting portion, and the strip connecting portion generates an obvious wooden pile effect while the terminals transmit high-frequency signals, thereby reducing the fidelity factor of high-frequency signal transmission, and resulting in poor work stability of the electrical connector.

Therefore, a heretofore unaddressed need to design an improved electrical connector and a terminal thereof exists in the art to address the aforementioned deficiencies and inadequacies.

SUMMARY

In view of the problems in the related art, an objective of the present invention is directed to an electrical connector with terminals capable of being intensively arranged and stably transmitting high-frequency signals, and a terminal thereof.

To achieve the foregoing objective, one aspect of the invention provides a terminal, which includes: a base, configured for being retained in an accommodating hole of an insulating body; a contact arm, formed by bending and extending upward from the base and configured for abutting a chip module; a conducting portion, formed by extending from the base and configured for being conductively connected with a circuit board; and a strip connecting portion, configured for being connected with a strip, wherein a plate surface of the strip connecting portion is attached to a plate surface of the contact arm.

In certain embodiments, the terminal further includes a first arm formed by bending and then extending upward vertically from the base, a second arm formed by bending and extending upward from the first arm, and a contact portion formed by continuously bending and extending upward from the second arm and configured for abutting the chip module, wherein the strip connecting portion is vertical and is attached to a vertical plate surface of the first arm.

In certain embodiments, the first arm and the second arm bend toward a same direction.

In certain embodiments, the first arm and the second arm respectively bend toward opposite directions.

In certain embodiments, the strip connecting portion includes a flat plate portion attached to the first arm, and a strip breaking portion extending upward from the flat plate portion, wherein a thickness of a plate surface of the flat plate portion is greater than a thickness of a plate surface of the strip breaking portion, a height of the strip breaking portion is greater than a height of the first arm, and a gap exists between the strip breaking portion and the second arm.

In certain embodiments, a width of the flat plate portion is consistent in a vertical direction.

In certain embodiments, the flat plate portion includes a main body portion and a connecting portion formed by extending vertically upward from the main body portion, two clamping portions are formed by bending and extending from two opposite sides of the main body portion to clamp two opposite plate edges of the first arm, a length of the main body portion is identical to a length of each of the clamping portions in a vertical direction, and the connecting portion is not in contact with the contact arm.

In certain embodiments, the strip connecting portion and the first arm are welded together so that the strip connecting portion is fixed to the contact arm, a width of the strip connecting portion is consistent in a vertical direction, and a width of the plate surface of the strip connecting portion is identical to a width of the vertical plate surface of the first arm.

In certain embodiments, a protruding portion is protrudingly provided on the plate surface of the strip connecting portion toward the first arm, and the protruding portion abuts the vertical plate surface of the first arm.

In certain embodiments, the strip connecting portion has two clamping portions to clamp two opposite plate edges of the contact arm.

In certain embodiments, the conducting portion is formed by extending downward from the base and is configured for being soldered to the circuit board, and a tail end of the conducting portion is connected with another strip.

In certain embodiments, the strip connecting portion is not in contact with side surfaces of the accommodating hole.

In certain embodiments, when the strip is removed, the strip is not broken from the strip connecting portion, and the strip connecting portion is removed together with the strip.

In another aspect, an electrical connector includes: an insulating body, having a plurality of accommodating holes; and a plurality of terminals, each being provided with: a base, configured for being retained in one of the accommodating holes; a contact arm, formed by bending and extending upward from the base and configured for abutting a chip module; a conducting portion, formed by extending from the base and configured for being conductively connected with a circuit board; and a strip connecting portion, configured for being connected with a strip, wherein a plate surface of the strip connecting portion is attached to a plate surface of the contact arm.

In certain embodiments, a first arm is formed by bending and then extending upward vertically from the base, a second arm is formed by bending and extending upward from the first arm, a contact portion is formed by continuously bending and extending upward from the second arm and configured for abutting the chip module, and the strip connecting portion is vertical and is attached to a vertical plate surface of the first arm.

In certain embodiments, the strip connecting portion and the first arm are welded together so that the strip connecting portion is fixed to the contact arm, a width of the strip connecting portion is consistent in a vertical direction, and a width of the plate surface of the strip connecting portion is identical to a width of the vertical plate surface of the first arm.

In certain embodiments, a protruding portion is protrudingly provided on the plate surface of the strip connecting portion toward the first arm, and the protruding portion abuts the vertical plate surface of the first arm.

In certain embodiments, the strip connecting portion has two clamping portions to clamp two opposite plate edges of the contact arm.

In certain embodiments, the conducting portion is formed by extending downward from the base and is configured for being soldered to the circuit board, and a tail end of the conducting portion is connected with another strip.

In certain embodiments, the strip connecting portion is not in contact with side surfaces of the one of the accommodating holes.

Compared with the related art, the present invention has the following beneficial effects.

In the electrical connector, since the plate surface of the strip connecting portion is attached to the plate surface of the contact arm, a width of the terminal is not increased, thereby facilitating intensive arrangement of the terminals, reducing a gap between the strip connecting portion and the plate surface of the contact arm, preventing from the wooden pile effect of the strip connecting portion that may affect the high-frequency signal transmission quality of the terminals, and increasing the fidelity factor of high-frequency signal transmission of the terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment.

DETAILED DESCRIPTION

Figure 1:
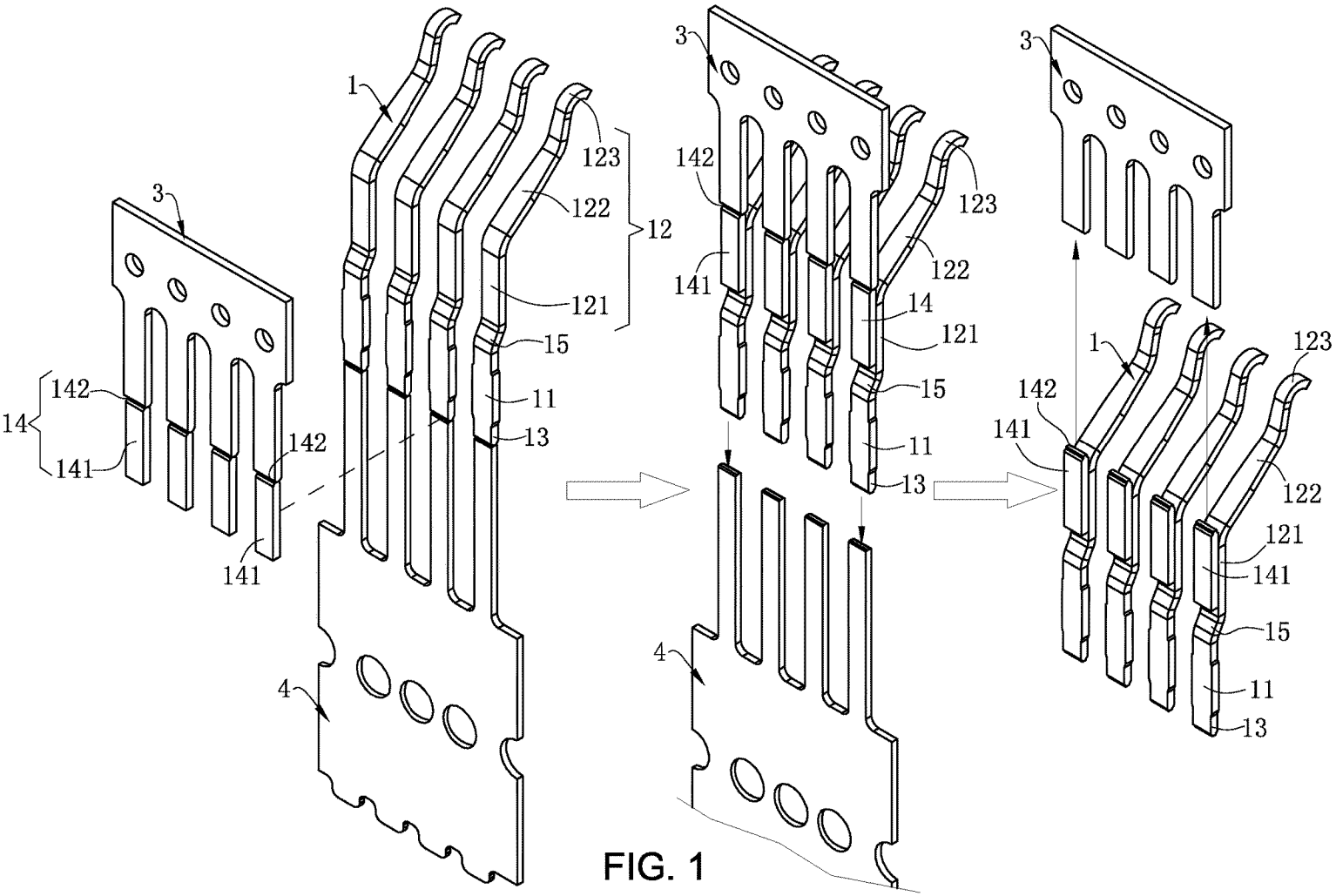
FIG. 1 is a schematic view of a process of installing a strip connecting portion to a terminal of an electrical connector and then removing a strip according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-8. In accordance with the purposes of this invention, as embodied and broadly described herein, this invention, in one aspect, relates to an electrical connector and a terminal thereof.

FIG. 1 to FIG. 5 show an electrical connector 100 according to a first embodiment of the present invention. The electrical connector 100 includes an insulating body 2 and a plurality of terminals 1 retained to the insulation body 2. Each terminal 1 extends upward out of the insulation body 2 to abut a chip module 5, and extends downward out of the insulation body 2 to be electrically connected with a circuit board 6 conductively.

Figure 3:
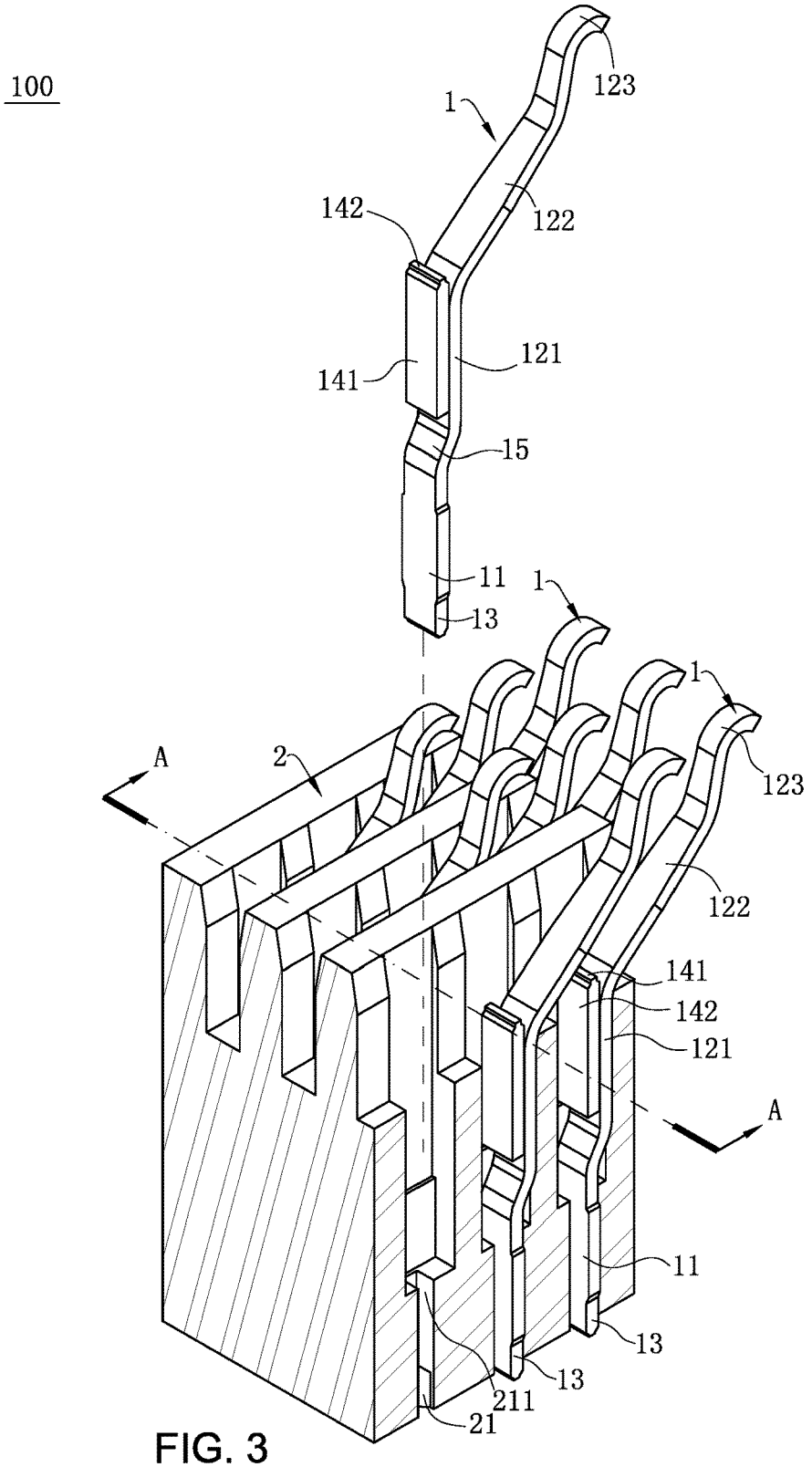
FIG. 3 is a partial perspective assembled view of the electrical connector according to the first embodiment of the present invention.
Figure 4:
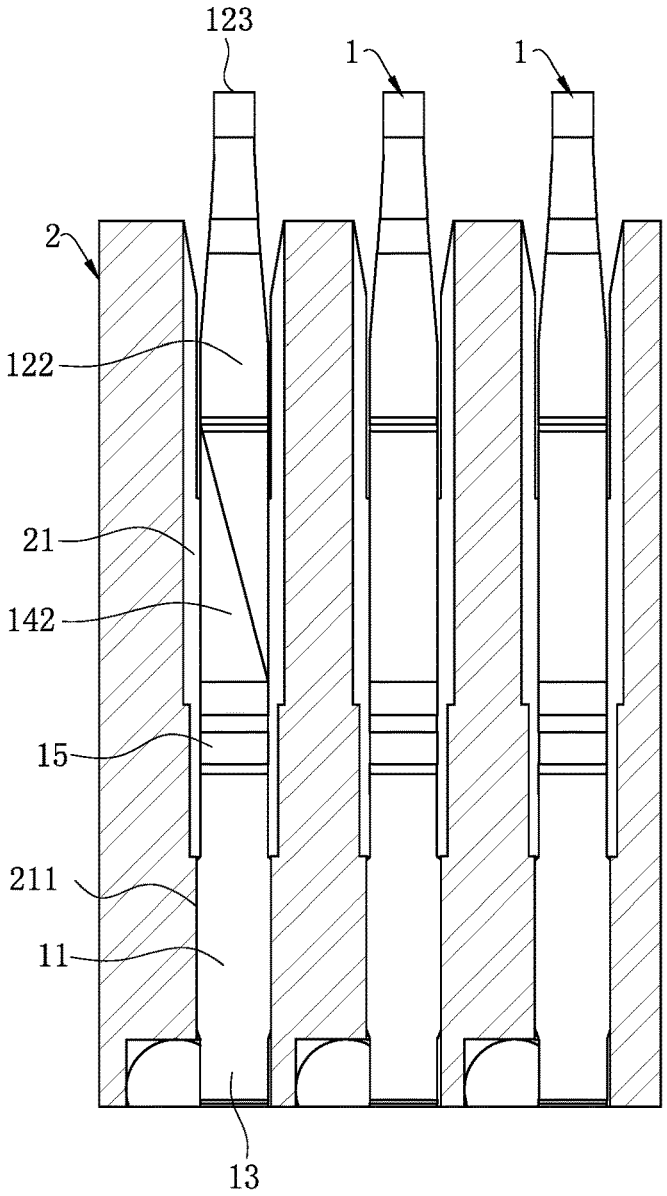
FIG. 4 is a sectional view of the electrical connector according to the first embodiment of the present invention along the A-A line.

As shown in FIG. 3 and FIG. 4, multiple accommodating holes 21 are formed in the insulation body 2 penetrating through an upper surface and a lower surface of the insulating body 2. Each accommodating hole 21 accommodates a corresponding one of the terminals 1, and each accommodating hole 21 has four side surfaces 211 to surround the corresponding terminal 1.

Figure 2:
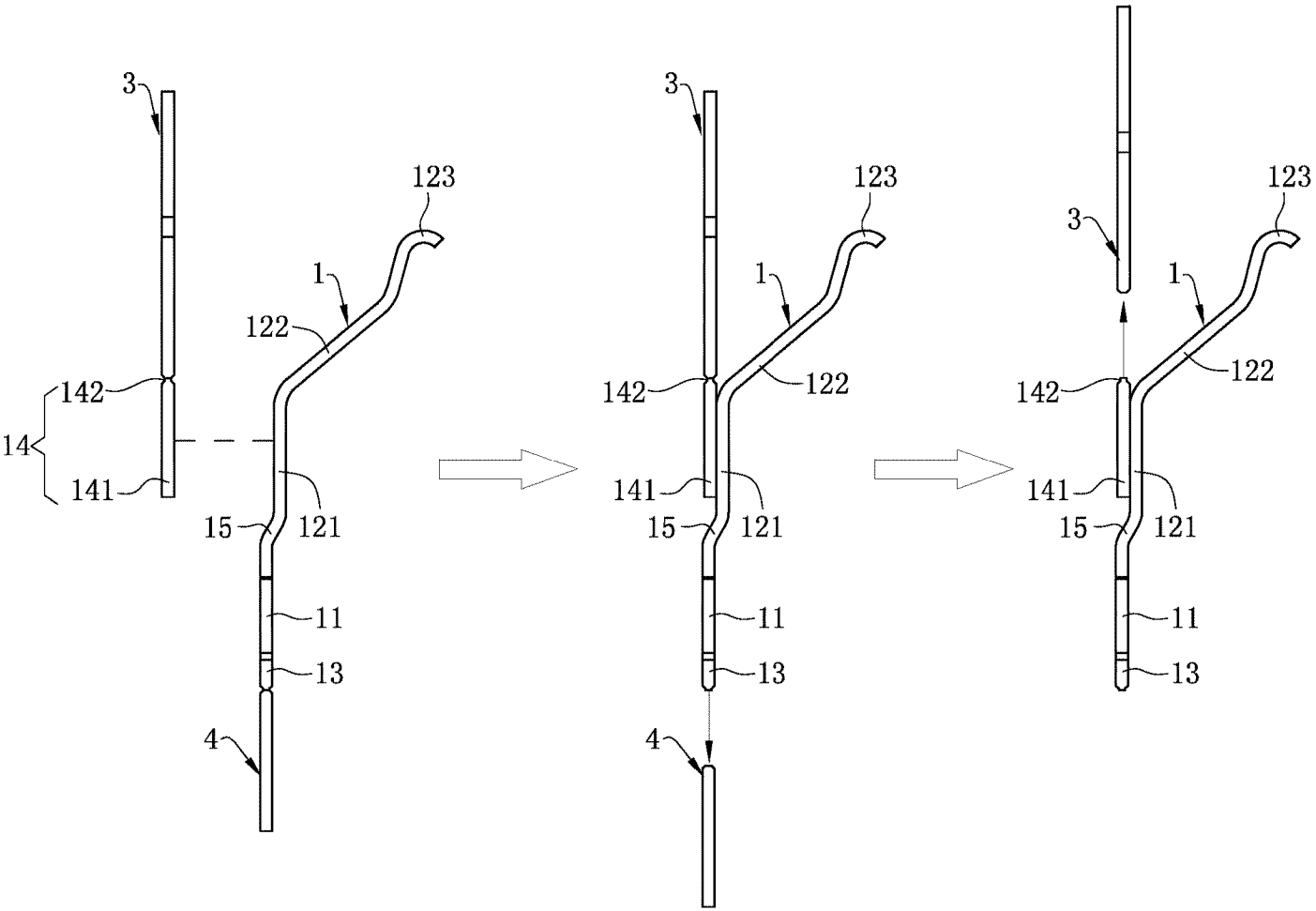
FIG. 2 is a side view of the process as shown in FIG. 1.
Figure 5:
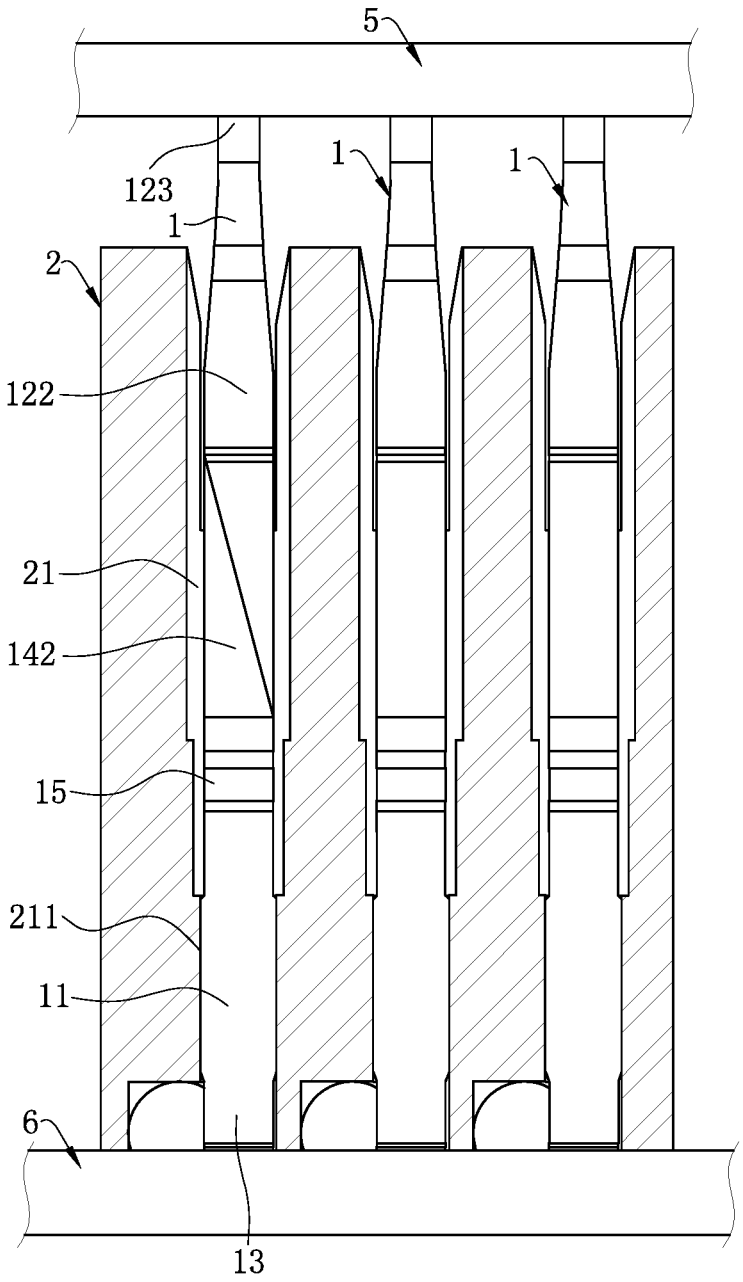
FIG. 5 is a sectional view of the electrical connector after being assembled to a chip module and a circuit board according to the first embodiment of the present invention.

As shown in FIG. 1, FIG. 2 and FIG. 5, the terminal 1 is formed through punching of a metal sheet, and includes a base 11 abutting the side surfaces 211 so that the terminal 1 is retained in the accommodating hole 21, and a contact arm 12. A top end of the base 11 bends and extends to form a bending portion 15. The contact arm 12 is formed by extending upward from the bending portion 15 for elastically abutting the chip module 5. Further, the contact arm 12 includes a first arm 121 formed by bending and then extending upward vertically from the base 11, a second arm 122 formed by bending and extending in the same direction from the first arm 121, and a contact portion 123 formed by continuously bending and extending upward from the second arm 122. In this way, the contact portion 123 can have high elasticity so as to elastically abut the chip module 5, thereby improving conduction stability between the terminal 1 and the chip module 5.

A strip connecting portion 14 is provided with a flat plate portion 141 with a consistent width in a vertical direction. The flat plate portion 141 is attached to a plate surface of the first arm 121 so that the strip connecting portion 14 is fixed to the first arm 121. Further, the strip connecting portion 14 is located above the base 11. A strip breaking portion 142 is formed by extending upward from the flat plate portion 141. A top end of the strip breaking portion 142 is connected with a first strip 3, and the first strip 3 is clamped by a jig to drive a row of terminals 1 to be simultaneously mounted in the accommodating holes 21. Since the plate surface of the flat plate portion 141 is attached to the plate surface of the first arm, a gap between the strip connecting portion 14 and the plate surface of the contact arm 12 is reduced, thereby preventing from the wooden pile effect of the strip connecting portion 14 that may affect the high-frequency signal transmission quality of the terminals 1, and increasing the fidelity factor of high-frequency signal transmission of the terminals 1. In the embodiment, the flat plate portion 141 and the first arm 121 are welded together. In other embodiments, the fixing way of the flat plate portion 141 and the first arm 121 is not limited, as long as the plate surface of the strip connecting portion 14 can be attached to the plate surface of the contact arm 12. Further, the strip connecting portion 14 is not in contact with the side surfaces 211 of the accommodating hole 21, so as to eliminate the interference resistance generated by the side surfaces 211 on the strip connecting portion 14 while the terminal 1 is mounted in the accommodating hole 21, thus avoiding the movement of the strip connecting portion 14 relative to the contact arm 12, and increasing the stability of the terminal 1.

Preferably, a thickness of the plate surface of the flat plate portion 141 is greater than a thickness of the plate surface of the strip breaking portion 142, thus reducing the resistance of breaking the first strip 3 on the strip breaking portion 142. A height of the strip breaking portion 142 is greater than a height of the first arm 121, and a gap exists between the strip breaking portion 142 and the second arm 122 to provide a space for swinging of the first strip 3 forward and backward during breaking, thus reducing the breaking difficulty. Further, a width of the strip connecting portion 14 is consistent in the vertical direction, and a width of the plate surface of the strip connecting portion 14 is identical with a width of the vertical plate surface of the first arm 121. When the plate surface of the strip connecting portion 14 is attached to the plate surface of the first arm 121, the overall width of each terminal 1 is not increased, thereby facilitating an intensive arrangement of the terminals 1 in the insulating body 2.

Furthermore, a conducting portion 13 is formed by extending downward from the base 11 for being soldered to the circuit board 6, and a tail end of the conducting portion 13 is connected with a second strip 4.

As shown in FIG. 1 and FIG. 3, during assembly of the electrical connector 100 of the present invention, the second strip 4 is clamped by a jig so that the terminals 1 are arranged in rows. Then the first strip 3 is clamped by another jig so that the strip connecting portions 14 are one-to-one correspondingly welded to the contact arms 12. The second strip 4 is then removed, and the jig clamping the first strip 3 drives the terminals 1 to be inserted downward into the accommodating holes 21 row-by-row. Finally, the first strip 3 is broken.

Figure 6:
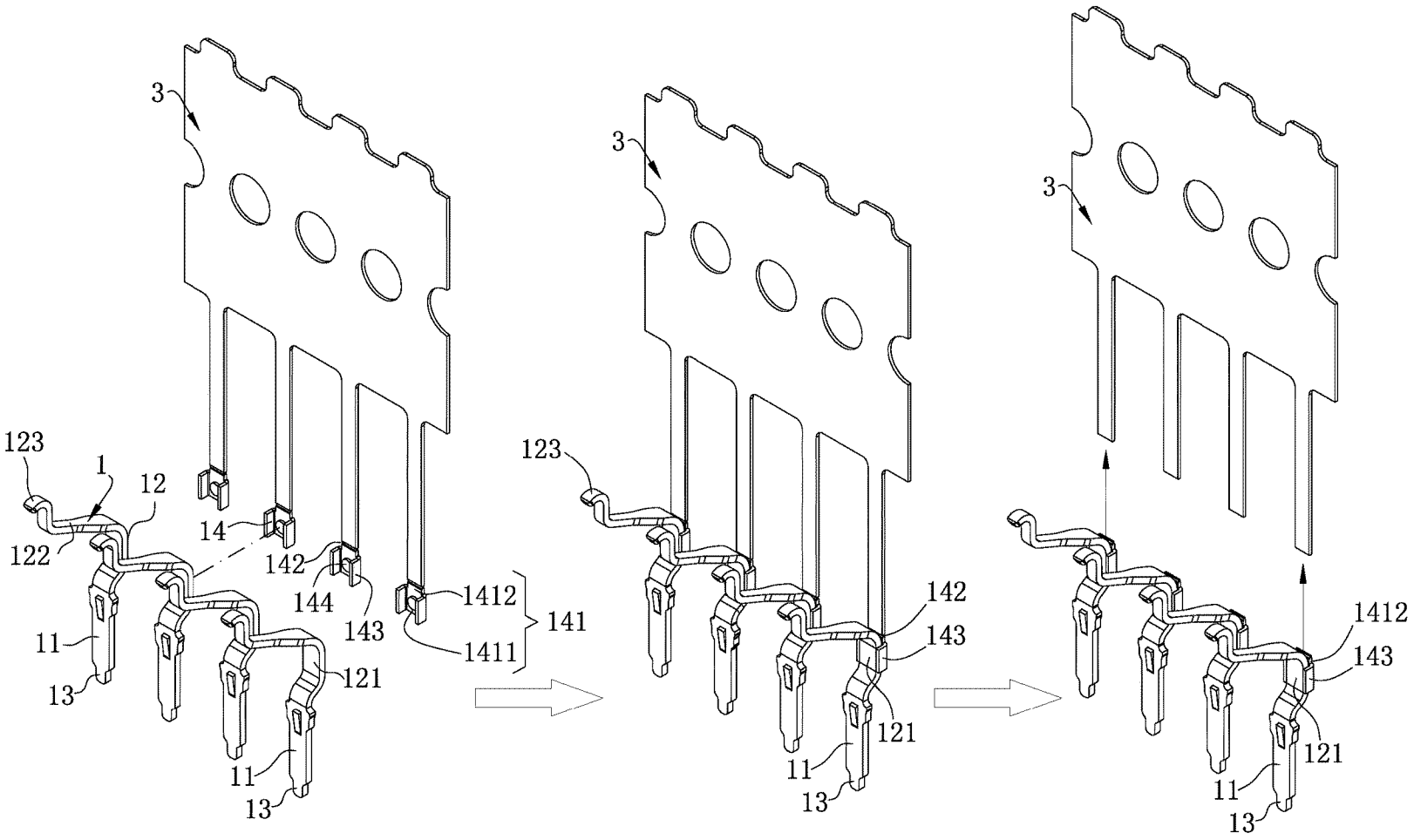
FIG. 6 is a schematic view of a process of installing a strip connecting portion to a terminal of an electrical connector and then removing a strip according to a second embodiment of the present invention.
Figure 7:
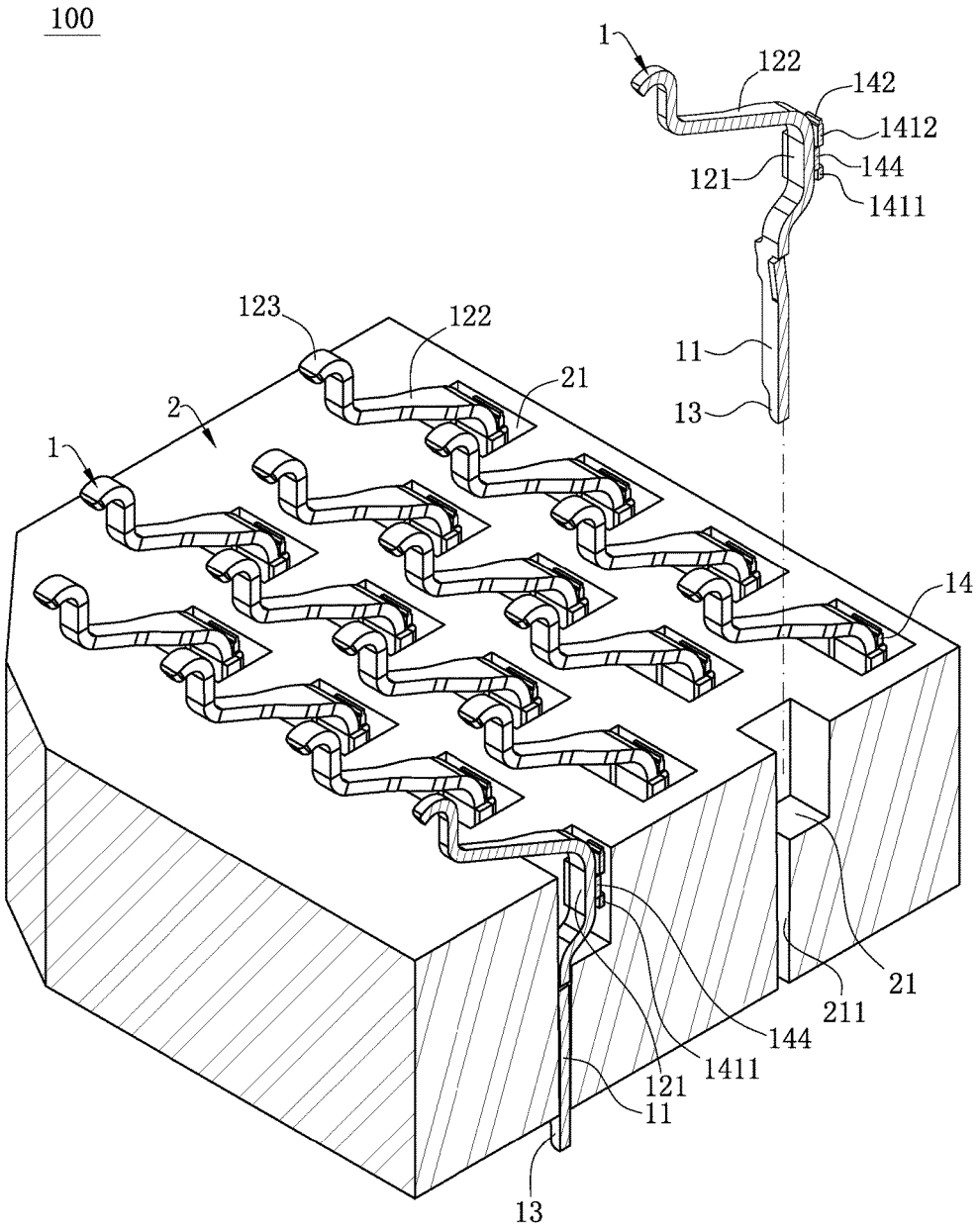
FIG. 7 is a partial perspective assembled view of the electrical connector according to the second embodiment of the present invention.

FIG. 6 and FIG. 7 show an the electrical connector 100 according to a second embodiment of the present invention, which is different from the first embodiment in that the second arm 122 and the first arm 121 respectively bend in opposite directions, so as to reduce the space occupied by the contact arm 12 in the horizontal direction.

The flat plate portion 141 is provided with a main body portion 1411 and a connecting portion 1412 formed by extending vertically upward from the main body portion 1411. The connecting portion 1412 is connected with the strip breaking portion 142, and two clamping portions 143 are formed by bending and extending from two opposite sides of the main body portion 1411 to clamp two opposite plate edges of the first arm 121, so that the strip connecting portion 14 is retained to the first arm 121. In the vertical direction, a length of the main body portion 1411 is identical to a length of each clamping portion 143. The connecting portion 1412 is not in contact with the contact arm 12. A protruding portion 144 is protrudingly provided on the plate surface of the main body portion 1411 towards the first arm 121, and the protruding portion 144 abuts the vertical plate surface of the first arm 121, so as to guarantee stable contact between the strip connecting portion 14 and the contact arm 12.

Figure 8:
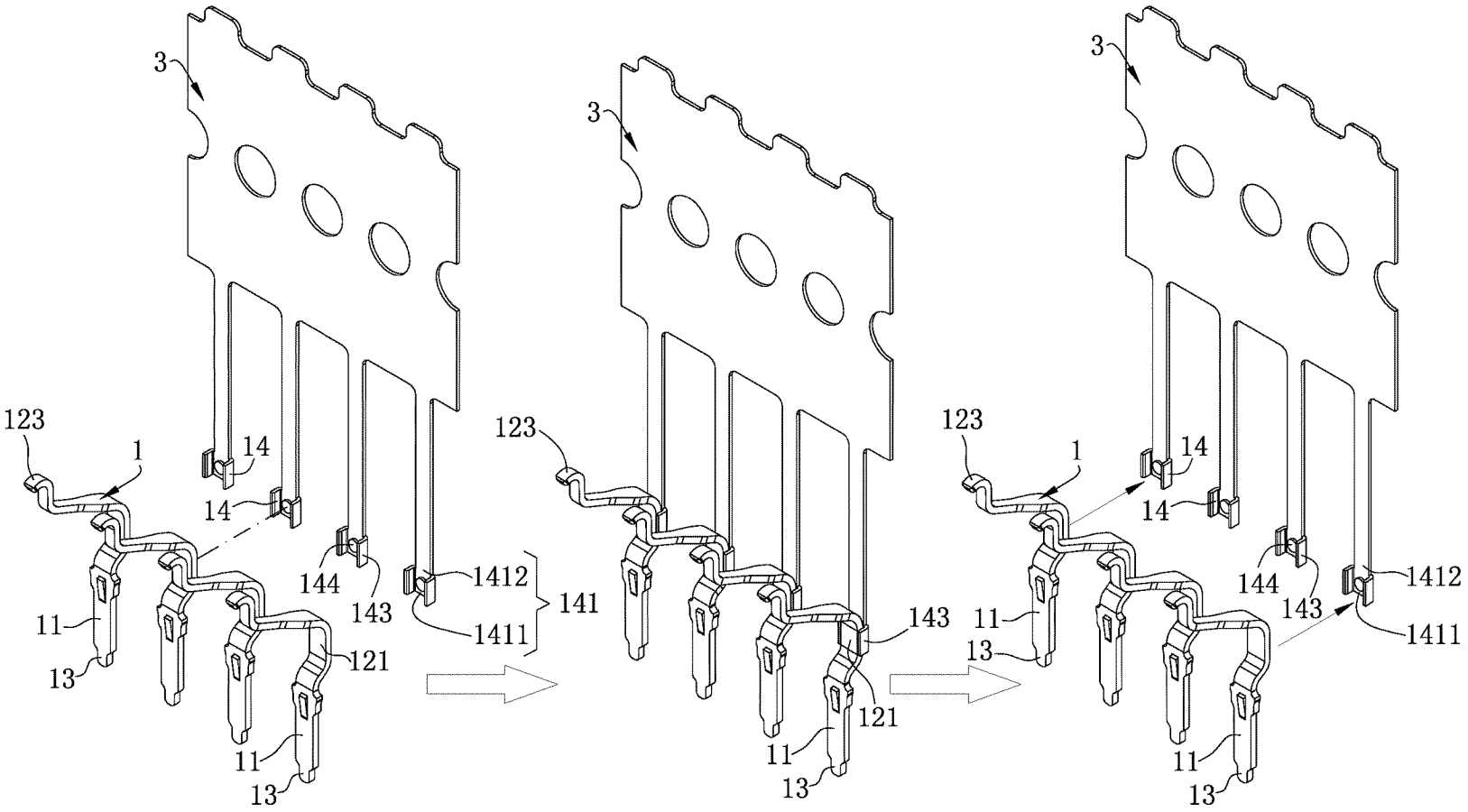
FIG. 8 is a schematic view of a process of installing a strip connecting portion to a terminal of an electrical connector and then removing a strip according to a third embodiment of the present invention.

FIG. 8 shows a third embodiment of the present invention, which is different from the second embodiment in that the connecting portion 1412 does not extend upward to form the strip breaking portion 142, and is instead directly connected with the first strip 3. When the first strip 3 is removed, the strip connecting portion 14 can be simultaneously removed from the contact arm 12, thus reducing the thickness of each terminal 1, and thereby reducing the distance between each two adjacent terminals 1 and further facilitating the intensive arrangement of the terminals 1. Other structures of the embodiment are exactly identical to those of the second embodiment, and thus are not elaborated herein.

To sum up, the electrical connector 100 according to certain embodiments of the present invention has the following beneficial effects.

(1) Since the plate surface of the strip connecting portion 14 is attached to the plate surface of the contact arm 12, a gap between the plate surface of the strip connecting portion 14 and the plate surface of the contact arm 12 is reduced, thereby preventing from the wooden pile effect of the strip connecting portion 14 that may affect the high-frequency signal transmission quality of the terminals 1, and increasing the fidelity factor of high-frequency signal transmission of the terminals 1.

(2) A width of the strip connecting portion 14 is consistent in the vertical direction, and a width of the plate surface of the strip connecting portion 14 is identical with a width of the vertical plate surface of the first arm 121. When the plate surface of the strip connecting portion 14 is attached to the plate surface of the first arm 121, the overall width of each terminal 1 is not increased, thereby facilitating an intensive arrangement of the terminals 1 in the insulating body 2.

(3) A thickness of the plate surface of the flat plate portion 141 is greater than a thickness of the plate surface of the strip breaking portion 142, thus reducing the resistance of breaking the first strip 3 on the strip breaking portion 142.

(4) The strip connecting portion 14 is not in contact with the side surfaces 211 of the accommodating hole 21, so as to eliminate the interference resistance generated by the side surfaces 211 on the strip connecting portion 14 while the terminal 1 is mounted in the accommodating hole 21, thus avoiding the movement of the strip connecting portion 14 relative to the contact arm 12, and increasing the stability of the terminal 1.

The above detailed description only describes preferable embodiments of the present invention, and is not intended to limit the patent scope of the present invention, so any equivalent technical changes made by use of the specification of the creation and the content shown in the drawings fall within the patent scope of the present invention.

While there has been shown several and alternate embodiments of the present invention, it is to be understood that certain changes can be made as would be known to one skilled in the art without departing from the underlying scope of the present invention as is discussed and set forth above and below including claims. Furthermore, the embodiments described above and claims set forth below are only intended to illustrate the principles of the present invention and are not intended to limit the scope of the present invention to the disclosed elements.

What is claimed is:

1. A terminal, comprising:

a base, configured for being retained in an accommodating hole of an insulating body, wherein a top end of the base bends to form a bending portion;

a contact arm, formed by extending upward from the bending portion and configured for abutting a chip module;

a conducting portion, formed by extending from the base and configured for being conductively connected with a circuit board; and a strip connecting portion, configured for being connected with a strip, wherein a plate surface of the strip connecting portion is attached to a plate surface of the contact arm, and the strip connecting portion is located above the bending portion.

2. The terminal according to claim 1, wherein the contact arm comprises a first arm formed by bending and then extending upward vertically from the base, a second arm formed by bending and extending upward from the first arm, and a contact portion formed by continuously bending and extending upward from the second arm and configured for abutting the chip module, wherein the strip connecting portion is vertical and is attached to a vertical plate surface of the first arm.

3. The terminal according to claim 2, wherein the first arm and the second arm bend toward a same direction.

4. The terminal according to claim 2, wherein the first arm and the second arm respectively bend toward opposite directions.

5. The terminal according to claim 2, wherein the strip connecting portion comprises a flat plate portion attached to the first arm, and a strip breaking portion extending upward from the flat plate portion, wherein a thickness of a plate surface of the flat plate portion is greater than a thickness of a plate surface of the strip breaking portion, a height of the strip breaking portion is greater than a height of the first arm, and a gap exists between the strip breaking portion and the second arm, and a width of the flat plate portion is consistent in a vertical direction.

6. The terminal according to claim 5, wherein the flat plate portion comprises a main body portion and a connecting portion formed by extending vertically upward from the main body portion, two clamping portions are formed by bending and extending from two opposite sides of the main body portion to clamp two opposite plate edges of the first arm, a length of the main body portion is identical to a length of each of the clamping portions in a vertical direction, and the connecting portion is not in contact with the contact arm.

7. The terminal according to claim 2, wherein the strip connecting portion and the first arm are welded together so that the strip connecting portion is fixed to the contact arm, a width of the strip connecting portion is consistent in a vertical direction, and a width of the plate surface of the strip connecting portion is identical to a width of the vertical plate surface of the first arm.

8. The terminal according to claim 2, wherein a protruding portion is protrudingly provided on the plate surface of the strip connecting portion toward the first arm, and the protruding portion abuts the vertical plate surface of the first arm.

9. The terminal according to claim 1, wherein the strip connecting portion has two clamping portions to clamp two opposite plate edges of the contact arm.

10. The terminal according to claim 1, wherein the conducting portion is formed by extending downward from the base and is configured for being soldered to the circuit board, and a tail end of the conducting portion is connected with another strip.

11. The terminal according to claim 1, wherein the strip connecting portion is not in contact with side surfaces of the accommodating hole.

12. The terminal according to claim 1, wherein when the strip is removed, the strip is not broken from the strip connecting portion, and the strip connecting portion is removed together with the strip.

13. An electrical connector, comprising:

an insulating body, having a plurality of accommodating holes; and a plurality of terminals, each being provided with:

a base, configured for being retained in one of the accommodating holes;

a contact arm, formed by bending and extending upward from the base and configured for abutting a chip module;

a conducting portion, formed by extending from the base and configured for being conductively connected with a circuit board; and a strip connecting portion, configured for being connected with a strip, wherein a plate surface of the strip connecting portion is attached to a plate surface of the contact arm, and the strip connecting portion is located above the base.

14. The electrical connector according to claim 13, wherein the contact arm comprises a first arm formed by bending and then extending upward vertically from the base, a second arm formed by bending and extending upward from the first arm, and a contact portion formed by continuously bending and extending upward from the second arm and configured for abutting the chip module, wherein the strip connecting portion is vertical and is attached to a vertical plate surface of the first arm.

15. The electrical connector according to claim 14, wherein the strip connecting portion and the first arm are welded together so that the strip connecting portion is fixed to the contact arm, a width of the strip connecting portion is consistent in a vertical direction, and a width of the plate surface of the strip connecting portion is identical to a width of the vertical plate surface of the first arm.

16. The electrical connector according to claim 14, wherein a protruding portion is protrudingly provided on the plate surface of the strip connecting portion toward the first arm, and the protruding portion abuts the vertical plate surface of the first arm.

17. The electrical connector according to claim 13, wherein the strip connecting portion has two clamping portions to clamp two opposite plate edges of the contact arm.

18. A terminal, comprising:

a base, configured for being retained in an accommodating hole of an insulating body;

a contact arm, formed by extending upward from the base and configured for abutting a chip module;

a conducting portion, formed by extending from the base and configured for being conductively connected with a circuit board; and a strip connecting portion, configured for being connected with a strip, wherein a plate surface of the strip connecting portion is attached to a plate surface of the contact arm, and the strip connecting portion in its full length is located above the base.

19. The terminal according to claim 18, wherein the contact arm is formed by bending and extending upward from the base, such that a plate surface of the contact arm and a plate surface of the base are located on different planes.

20. The terminal according to claim 18, wherein the contact arm comprises a first arm formed by bending and then extending upward vertically from the base, a second arm formed by bending and extending upward from the first arm, and a contact portion formed by continuously bending and extending upward from the second arm and configured for abutting the chip module, wherein the strip connecting portion is vertical and is attached to a vertical plate surface of the first arm.

* * * * *